US005954977A

United States Patent [19]

Miller et al.

[11] Patent Number: 5,954,977

[45] Date of Patent: Sep. 21, 1999

[54] METHOD FOR PREVENTING BIOFOULING IN AQUATIC ENVIRONMENTS

[75] Inventors: Charles G. Miller, Branford, Conn.; John A. Rolls, Armonk, N.Y.; Otis H. Hastings, Mahwah, N.J.

[73] Assignee: Thermion Systems International, Stratford, Conn.

[21] Appl. No.: 08/633,967

[22] Filed: Apr. 19, 1996

[51] Int. Cl.[6] ..... H05B 1/00; H05B 3/34

[52] U.S. Cl. ..... 219/201; 219/529

[58] Field of Search ..... 219/201, 523, 219/213, 544, 528, 529, 543, 548, 549; 338/255–257, 262, 292, 308; 404/71, 79; 405/211, 211.1, 216; 119/204, 234

[56] References Cited

U.S. PATENT DOCUMENTS

| | | | |
|---|---|---|---|
| 3,309,267 | 3/1967 | Galler | 404/71 |
| 3,392,575 | 7/1968 | Galler | 392/435 |
| 3,557,344 | 1/1971 | Crosta et al. | 392/503 |
| 3,657,516 | 4/1972 | Fujihara . | |
| 3,803,386 | 4/1974 | Rodrigues | 219/523 |
| 3,859,504 | 1/1975 | Motokawa et al. . | |
| 3,890,486 | 6/1975 | Fitzgerald | 219/523 |
| 4,039,720 | 8/1977 | Cherenko et al. . | |
| 4,110,151 | 8/1978 | Morse . | |
| 4,245,149 | 1/1981 | Fairlie . | |
| 4,250,397 | 2/1981 | Grey et al. . | |
| 4,282,049 | 8/1981 | Morse . | |
| 4,534,886 | 8/1985 | Kraus et al. . | |
| 4,734,231 | 3/1988 | Morita et al. . | |
| 4,737,618 | 4/1988 | Barbier et al. . | |
| 4,814,567 | 3/1989 | De Angelis et al. | 219/628 |
| 4,942,078 | 7/1990 | Newman et al. . | |
| 4,972,197 | 11/1990 | McCauley et al. | 343/704 |
| 5,152,637 | 10/1992 | Wayne | 405/127 |
| 5,240,674 | 8/1993 | Armor | 422/6 |
| 5,250,228 | 10/1993 | Bairgrie et al. . | |
| 5,294,351 | 3/1994 | Clum et al. | 210/774 |
| 5,327,848 | 7/1994 | Hannon, Jr. . | |
| 5,344,696 | 9/1994 | Hastings et al. | 219/529 |
| 5,361,183 | 11/1994 | Wiese . | |
| 5,389,266 | 2/1995 | Clum et al. | 210/774 |

FOREIGN PATENT DOCUMENTS

| | | |
|---|---|---|
| 496388 | 7/1992 | European Pat. Off. . |
| 52-89253 | 7/1977 | Japan . |
| 2-153105 | 6/1990 | Japan . |
| 9515670 | 6/1995 | WIPO . |

*Primary Examiner*—Teresa Walberg
*Assistant Examiner*—Daniel Robinson
*Attorney, Agent, or Firm*—White & Case LLP

[57] ABSTRACT

A method is provided for preventing biofouling on the surface of structures, such as docks, ships, oil drilling platforms, which come into contact with aquatic environments. In the method, a pre-formed panel heater element is provided to the surfaces of the structure which are for submerging into water. The heater element is disposed at a predetermined depth from the surface of the structure, and energized at prescribed intervals and temperature which are effective to kill and prevent settlement of larvae on the surface of the structure. The pre-formed panel heater element consists of an inner layer composed of a fabric of electrically conductive fibers encapsulated in fiberglass/resin; two outer fiberglass/resin layers disposed on opposing surfaces of and encapsulating said inner layer; and electrical leads connected to said conductive fibers and adapted to receive power from a power source.

5 Claims, 3 Drawing Sheets

METHOD FOR PREVENTING BIOFOULING IN AQUATIC ENVIRONMENTS

BACKGROUND OF THE INVENTION

1. Field of the Invention

The present invention relates generally to a method for preventing the development of biofouling on the surface of structures that come into contact with aquatic environments. Specifically, the invention relates to the use of a laminated heater element impermeable to water, disposed on the surface of such structures to prevent biofouling on the surface.

2. Description of the Prior Art

Biofouling is defined as the settlement and attachment of aquatic plants and animals onto hard substrates introduced into the aquatic environment by human activity. Biofouling can occur within both marine and freshwater systems. Biofouling is initiated by the establishment of a film of bacteria on the newly submerged surface. The bacterial film promotes the colonization of larger multicellular species on the surface through the enhancement of larval settlement, specifically by inducing a metamorphosis in the fouling organism from a mobile larval stage to a sessile juvenile stage.

Biofouling on fixed or suspended structures in the water, such as docks, buoys, power plant inlet-outlet water pipes, or oil drilling platforms can cause a variety of problems. The weight of the fouling biomass places undue stress on the structure. In addition, the biomass promotes metal corrosion or degradation of wood products, and reduces the visibility of submerged structures during inspections. Biofouling on ships occurs when ships are at dockside rather than when they are at sea, but the fouling organisms increases drag on the hull while the ship is moving. Barnacle fouling alone can raise fuel consumption of an oceangoing ship by 40% (Christie A. A. and R. Dalley. 1987. Barnacle fouling and its prevention. In: A. J. Southward (ed.) Barnacle Biology. A. A. Balkema. Rotterdam, NL. pp. 419–433).

Fouling organisms are comprised of between 4,000 and 5,000 different species within the marine environment alone (Crisp, D. J. 1972a. The role of the biologist in anti-fouling research. In: R. F. Acker, B.F. Brown, J. R. DePalma, and W. P. Iverson (eds.) Proceedings of the Third International Congress on Marine Corrosion and Fouling). It is virtually impossible to fully understand the biological characteristics of every fouling organism and to individually derive a means for controlling every single fouling species in the world. Therefore, control of fouling is approached by grouping fouling organisms into biologically relevant groups and selecting key species as representatives of each specific group. The key species for each general group are usually those species which are either the most common fouling organisms and/or a typical species that is well researched and understood, such as the marine algae, Enteromorpha and Ectocarpus species, which are considered the primary fouling genera; barnacles within the genus Crustacea; blue mussels of *Mytilus edulis*, and the zebra mussel within the *Dreisseria polymorpha*.

The dispersal of sessile aquatic organisms generally occurs during the early life stages of the organism. Many sessile organisms are mobile in early life. As the mobile larvae grow and mature, however, the organism seeks an appropriate surface for attachment. Larval settlement involves the organism undergoing a metamorphosis to its adult life form. This change involves an attachment to a hard surface either permanently, as in the case of barnacles cementing to a substrate, or temporarily, as in the case of mussels attaching to a substrate with byssal threads. The compositions used by organisms for both permanent or temporary attachment are predominantly proteins that are extensively cross-linked and therefore relatively impervious to external influences (Crisp, D. J. 1972b. Mechanisms of adhesion of fouling organisms. In: R. F. Acker, B. F. Brown, J. R. DePalma, and W. P. Iverson (eds.) Proceedings of the Third International Congress on Marine Corrosion and Fouling. National Bureau of Standards, Gaithersburg, Md. pp. 691–709). As such, the ideal means to control fouling is to stop it at its first settlement stage rather than later when the cemented structures are very difficult to remove.

Researchers have long attempted to develop means to effectively control biofouling. Fouling problems can be approached using a few basic considerations. These general approaches encompass:

1) killing the larvae as they contact the settlement surface;
2) discouraging the larvae from choosing the surface for settlement; or
3) interfering with the chemical processes involved with adhesion.

A variety of methods for controlling biofouling utilizing these approaches have been attempted. These methods include the use of mechanical, chemical and electrical eradication means to discourage settlement before it occurs or eradicate settlement after it has occurred. Acoustic, ultraviolet and thermal eradication and/or preventive methods have also been attempted. However, to date, a truly effective means for preventing such biofouling has not been developed.

SUMMARY OF THE INVENTION

The present invention comprises a method for preventing marine biofouling utilizing the approach of deterring and/or killing the larvae as they settle onto a surface of a structure exposed to an aquatic environment. The method comprises disposing onto the surface of a structure which is to be exposed to an aquatic environment a heater element such as, a laminated composite heater element impermeable to water, and heating the element at prescribed intervals and temperatures which are effective to deter larval settlement or kill the larvae as they settle onto the surface of such structure in the aquatic environment. In this manner, the settlement of fouling species of aquatic plants and animals can effectively be prevented.

DETAILED DESCRIPTION OF THE PREFERRED EMBODIMENT

The present invention comprises a method for preventing marine biofouling. The method comprises providing a laminated heater element, disposing the heater element on the surface of a structure to be exposed to an aquatic environment and heating the element at prescribed intervals and temperatures which are effective to deter larval settlement or kill the larvae as they settle onto the surface of such structure submerged in water.

The heater element of the present invention is a laminated composite, impermeable to water, and is of the type disclosed in U.S. Pat. No. 5,344,696 (Hastings et al.), which is incorporated herein by reference. As disclosed in the Hastings et al. patent, the heater element comprises a durable outer ply, which is resistant to abrasion and impermeable to water, bonded to and through a conductive layer of fibers, and an integrally enveloping adhesive, which is adhered to the surface of the structure. The conductive layer is connected to a source of electrical energy, and control means are adapted to control the temperature of the surface of the structure. This laminated structure is considered preferable; however, it is contemplated that other structures may be used. For example, the heater element need not be a laminated structure. Rather, the heater element may comprise merely a layer of conductive fibers. This structure of the heater element is particularly useful if the material into which the heater element is embedded has dielectric properties that will evenly distribute the heat generated by the element.

In one embodiment of the invention, the preferred heater element is manufactured under the trademark Thermion™ by Aerospace Safety Technologies, Inc. Thermion™ is light, flexible and may be translucent. The material is a laminate which provides even heating and can be conformed to surfaces having a variety of different contours and shapes. Operational power can be derived from low or high voltage AC or DC power supplies.

Figure 1:
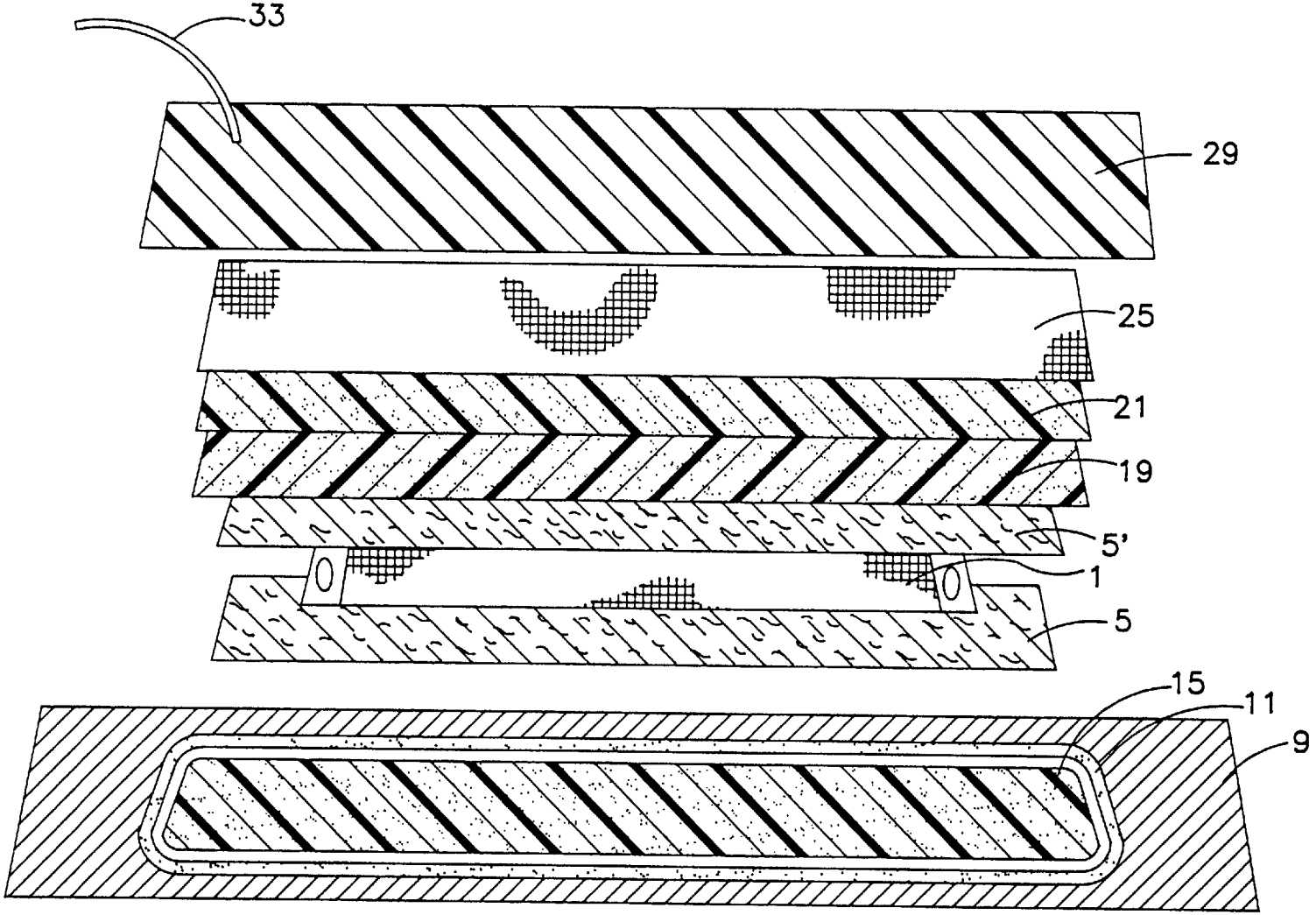
FIG. 1 depicts the construction of a composite heater element of the invention in a mold.
Figure 2A:
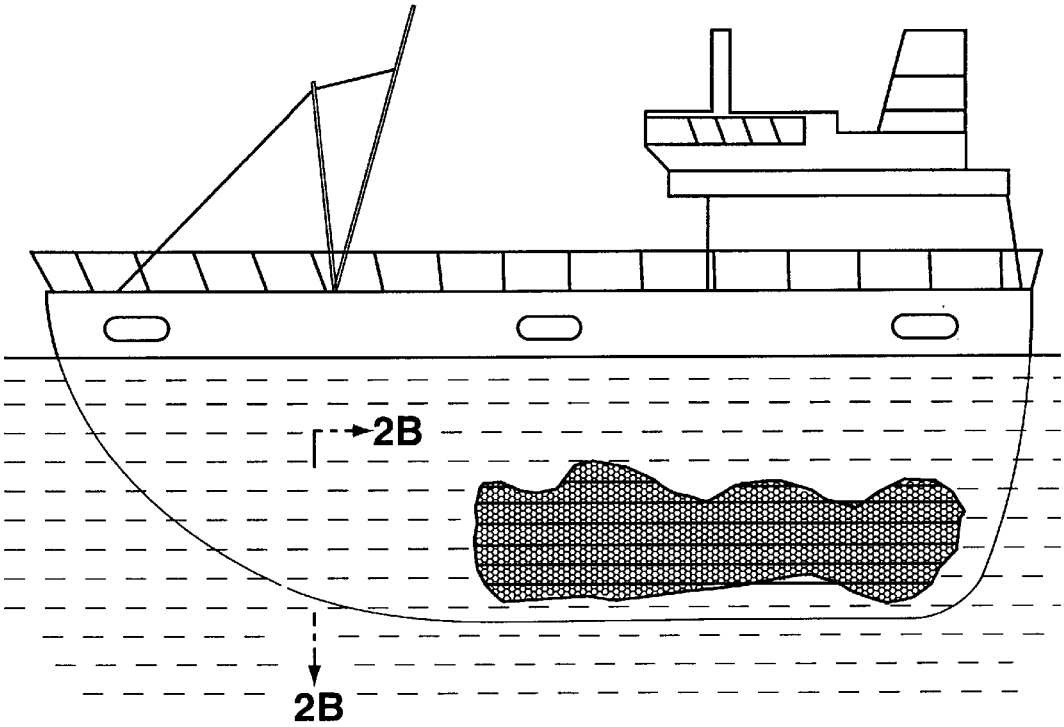
FIG. 2A is a drawing of a ship illustrating a cut-away view of portion of surface of the ship's body (side wall) to show the position of the layer of conductive fibers of the invention.
Figure 2B:
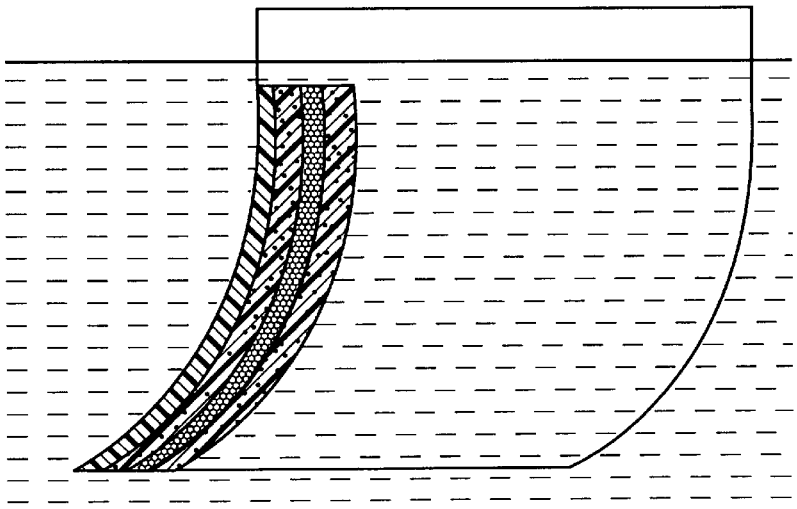
FIG. 2B is a section through the body wall of a ship showing the layer of conductive fibers of the invention.
Figure 3:
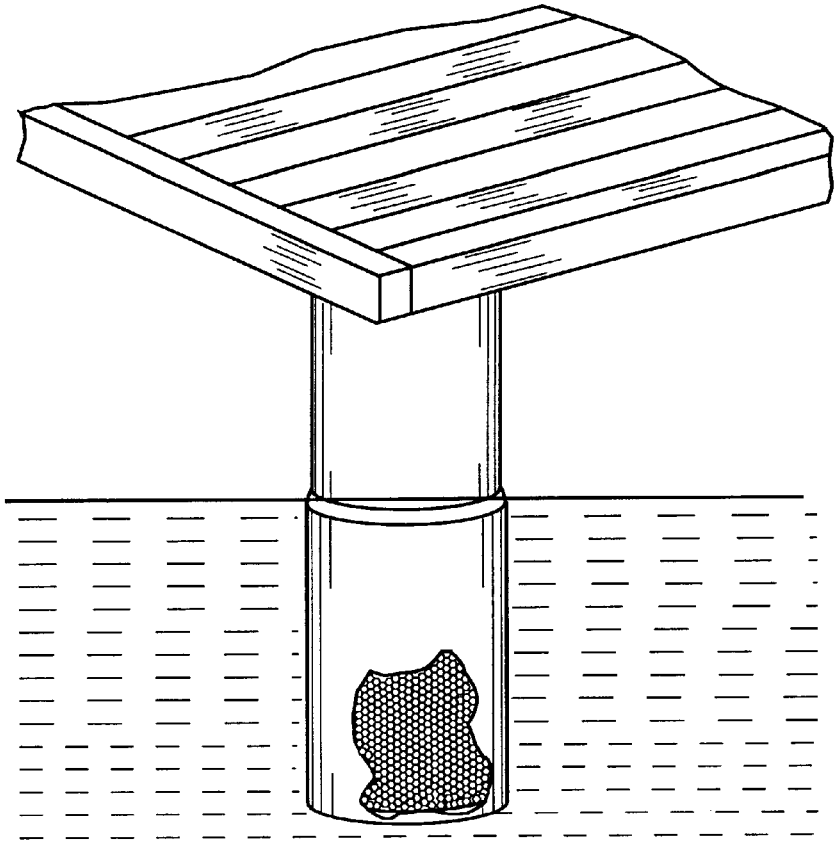
FIG. 3 depicts a cut-away portion of the surface of a submerged pillar of a dock showing the layer of conductive fibers of the invention.
Figure 4:
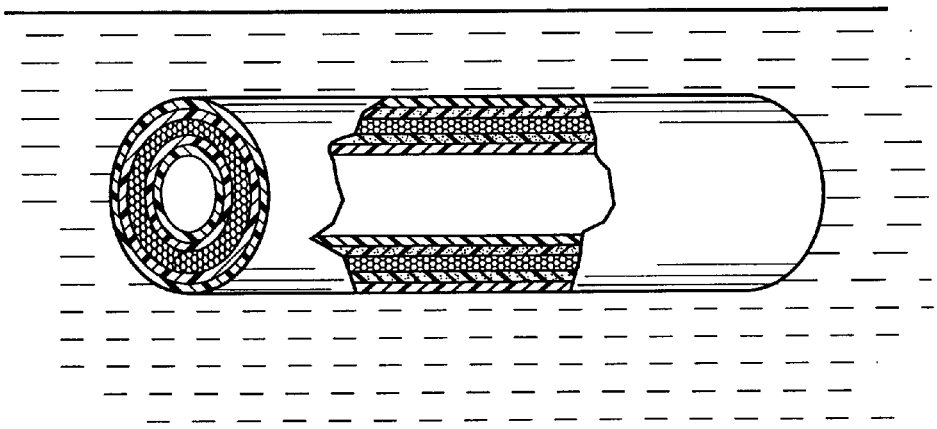
FIG. 4 illustrates a cut-away view of the surface of a submerged pipe showing the layer of conductive fibers of the invention.

A first variation in the method involves installing in the surface a pre-made panel, usually configured on a mold table for easy transfer to the final surface. As shown in FIG. 1, the pre-made panel comprises a fiberglass resin encapsulated heater element 1, further encapsulated in two cloths with resin added for bonding and fiberglass layers 5 and 5' with the necessary electrical connections to the heater element embedded as well (not shown). The electric leads (not shown) extend outside the panel and are required to apply the necessary electrical power. The laminate can be constructed with one or more layers of the fiberglass resin encapsulated heater element 1. This allows an additional parameter for design of the heater output. FIG. 1 shows how a single layer pre-made panel is formed on a transfer table. The fiberglass resin encapsulated heater element 1 is placed on top of a mold table surface 9. A mold release wax 15 is disposed between the encapsulated heater element 1 and the table surface 9.

A peel ply 19 is placed above the encapsulated heater element 1. A release ply 21 is disposed above the peel ply 19 and a bleeder cloth 25 is disposed over the release ply 21. Finally, a vacuum bag 29 is disposed over the release ply 21. A seal tape 11 surrounding the layers on the mold is attached to the table top surface 9, and can adhere to the vacuum bag 29 to create a tight seal. A vacuum supply 33 is used to evacuate the air between the layered material in order to bring the layers into close opposition with each other and cure the resin, bonding the layers to create the laminate.

In another embodiment, the heater element may comprise merely a layer of conductive fibers and may be directly embedded into a solid surface material. However, in this instance, the solid surface material, such as a thermoplastic or any thermoplastic formed item, must possess sufficient dielectric properties to evenly distribute the heat generated by the heater element.

The heater element is disposed at predetermined locations on the surface of the structure. These locations may vary according to the particular structure and type of biofouling organism for which biofouling prevention is anticipated. FIGS. 2A, 2B, 3 and 4 depict various submerged structures showing the layer of conductive fibers of the invention.

In order to make the laminated heater element effective, an initial consideration is the temperature required to kill the settled organisms or deter larvae from settling. In the present methods, the killing of the biofouling organisms or prevention of said organisms from attaching to the surface of a structure is accomplished by the heating the surface so as to increase its temperature. Most living tissues are sensitive to hyperthermia and the proteins which make up these tissues lose their biological activity or are denatured as the ambient temperature increases. Thus, effective hyperthermic temperatures must be reached to degrade the attachment proteins of the organisms in order to interrupt the connections of the organisms to the surface. The hyperthermia ultimately kills the organisms attached to the surface of the structure, and prevents other organisms from attaching, thereby, preventing biofouling.

It is well known that the typical upper lethal temperature for biofouling organisms such as crustaceans, mollusks, etc. is approximately 35–40° C. Thus, in the present methods, this is an effective temperature range required to prevent biofouling associated with these species. The effective temperatures for preventing biofouling are well below the temperature required to induced delamination of the structure.

An alternate means of defining the upper lethal thermal limit is by identifying it as an increase in temperature relative to the ambient temperature that the organism lives in. For example, it is known that if the absolute temperature rises approximately 17° C. above the ambient temperature it is generally considered that the temperature has reached the upper thermal limit for many marine organisms. This model could also predict a temperature necessary to prevent biofouling.

Given the known approximate upper lethal thermal limit for many aquatic fouling organisms, a secondary consideration is the time of exposure required to deter larvae settlement or kill the larvae upon settlement. No one particular exposure time can be given as applicable for all circumstances. Exposure time periods have been reported ranging from as little as 30 minutes to up to 24 hours. However, in this field it is generally known that knowledge of the particular biofouling organism can be used to predict an exposure time period which will effectively prevent settlement or kill the larvae upon settlement.

An additional consideration is whether the laminated heater element can achieve the desired temperature in a static and/or dynamic water immersion situation. It is contemplated that the particular temperature and exposure intervals can be adjusted to compensate for any adverse effects caused by these varying situations.

What is claimed is:

1. A method for preventing marine biofouling on the surface of a structure exposed to an aquatic environment, the method comprising:

providing a pre-formed panel heater element to the surfaces of the structure which are for submerging into water, wherein said pre-formed panel heater element consists of an inner layer composed of a fabric of electrically conductive fibers encapsulated between two fiberglass/resin layers; two outer fiberglass/resin layers disposed on opposing surfaces of said inner layer and encapsulating said inner layer; and electrical leads connected to said conductive fibers and adapted to receive power from a power source;

disposing the pre-formed panel heater element at a predetermined depth from the surface of the structure, and energizing the electrically conductive fibers at prescribed intervals and to a prescribed temperature to distribute heat evenly on the surface of the structure effective to prevent settlement of larvae or kill the larvae upon settlement.

2. The method of claim 1, wherein the prescribed temperature range is approximately 35–40° C.

3. The method of claim 1, wherein the prescribed intervals are from 30 minutes to 24 hours.

4. The method of claim 1, wherein the larvae species are from the genera Crustacea or Mollusca.

5. The method of claim 1, wherein the pre-formed panel heater element is in the form of a laminated composite.

* * * * *